US005353679A

United States Patent [19]

Nordmann

[11] Patent Number: 5,353,679

[45] Date of Patent: Oct. 11, 1994

[54] CIRCULATING AMMUNITION MAGAZINE

[75] Inventor: Adolf Nordmann, Erkrath, Fed. Rep. of Germany

[73] Assignee: Rheinmetall GmbH, Dusseldorf, Fed. Rep. of Germany

[21] Appl. No.: 968,349

[22] Filed: Oct. 29, 1992

[30] Foreign Application Priority Data

Nov. 2, 1991 [DE] Fed. Rep. of Germany .... 4136186.5

[51] Int. Cl.[5] ..... F41A 9/79

[52] U.S. Cl. ..... 89/34; 89/33.16; 89/35.01

[58] Field of Search ..... 89/34, 45, 46, 47, 33.02, 89/33.1, 33.14, 33.17, 33.05, 35.01, 33.16

[56] References Cited

U.S. PATENT DOCUMENTS

| | | | |
|---|---|---|---|
| 2,321,142 | 6/1943 | Horncastle | 89/33.14 |
| 2,365,392 | 12/1944 | Cooley | 89/34 |
| 2,708,390 | 5/1955 | Darsie | 89/35.01 |
| 3,762,328 | 10/1973 | Rocha | 89/35.01 |
| 4,137,821 | 2/1979 | Benedict | 89/35.01 |
| 4,873,911 | 10/1989 | Suchocki | 89/34 |
| 4,939,980 | 7/1990 | Zielinski | 89/46 |
| 5,170,006 | 12/1992 | Maher et al. | 89/45 |

FOREIGN PATENT DOCUMENTS

| | | | |
|---|---|---|---|
| 78893 | 2/1955 | Denmark | 89/33.17 |
| 581927 | 8/1933 | Fed. Rep. of Germany | 89/35.01 |
| 2207738 | 2/1989 | United Kingdom . | |

*Primary Examiner*—Stephen M. Johnson
*Attorney, Agent, or Firm*—Spencer, Frank & Schneider

[57] ABSTRACT

A circulating magazine including a housing (1) in which mutually articulated parallel ammunition containers (5;5') are disposed so as to accommodate ammunition (6,6') in an endless, two-layer transporting belt (4) driven by a drive (13;13'). To realize a quasi three-layer arrangement, guides (11,12; 11',12') for the ammunition containers (5;5') are provided in oppositely disposed container walls (2,3; 2',3') such that the ammunition containers (5,5') of one of the two layers are folded in an essentially zigzag nested arrangement.

16 Claims, 2 Drawing Sheets

1
2
3
4
5
5a
6
6'
7
8
9
10
11
12
13
14

CIRCULATING AMMUNITION MAGAZINE

BACKGROUND OF THE INVENTION

The present invention relates to a circulating ammunition magazine including a housing in which parallel arranged ammunition containers for accommodating ammunition are provided and are articulated together to form a rotatingly driven endless, two-layer transporting belt.

Such a circulating magazine is disclosed for example in Federal Republic of Germany Laid-Open patent application DE-OS 3,825,282 corresponding to U.S. Pat. No. 4,939,980. In this magazine, a plurality of ammunition containers are combined into a two-layer transporting belt. With a view toward the available space, there often remains unused space in such an arrangement which, however, is usually insufficient for a further two-layer rotating belt.

Federal Republic of Germany Laid-Open patent application DE-OS 3,936,469 corresponding to U.S. Pat. No. 4,873,911 discloses a circulating magazine in which tubular ammunition containers in two separate adjacent layers are arranged in an essentially zigzag offset so that the total height taken up by the ammunition containers is correspondingly less than four times the diameter of the container. This is accomplished by arranging the ammunition containers in the form of an inner continuous transporting belt and an outer continuous transporting belt, with the outer belt simultaneously serving to drive the inner belt. However, an essentially three-layer magazine cannot be realized in this manner.

SUMMARY OF THE INVENTION

It is therefore an object of the present invention to provide a circulating magazine of the type described above which is effectively a three-layer construction or has a height a little lower than a three-layer construction.

The above object is generally achieved according to the present invention by a circulating magazine which comprises: a housing defined by housing walls including at least two oppositely disposed end walls; a plurality of parallely arranged ammunition containers for accommodating ammunition units disposed in the housing and extending transverse to the two oppositely disposed end walls; means for articulatively connecting the containers together to form an endless transporting belt; drive means for rotating the endless transporting belt; and guide means, provided in the two oppositely disposed end walls of the housing, for guiding, and at least partially supporting, the ammunition containers such that the ammunition containers are disposed in two linearly extending layers, with the containers in one of said two layers being essentially folded and nested in a zigzag pattern.

Preferably, the guide means for the ammunition containers produces a folding effect of the containers to form the zigzag pattern in a first region wherein the transporting belt is being pushed by the drive means, and produces an unfolding effect in a second region wherein the transporting belt is being pulled by the drive means.

According to the preferred embodiment of the invention, the ammunition containers have a tubular configuration, the guide means comprise respective grooves formed in the two oppositely disposed end walls of the housing, each groove includes a first portion having a width corresponding to the diameter of the containers and a second portion having a width greater than that diameter, and each end of each container extends into the associated one of grooves.

According to a further embodiment of the invention, the ammunition containers have a tray-like configuration, a respective roller is mounted at each end surface of each ammunition container for rotation about a longitudinal axis of the respective container, and the rollers are laterally held and supported by the associated one of the guide grooves.

The invention will be described below in greater detail with reference to embodiments thereof that are illustrated in the attached drawing figures.

DETAILED DESCRIPTION OF THE PREFERRED EMBODIMENT

Figures 1, 2, 3:
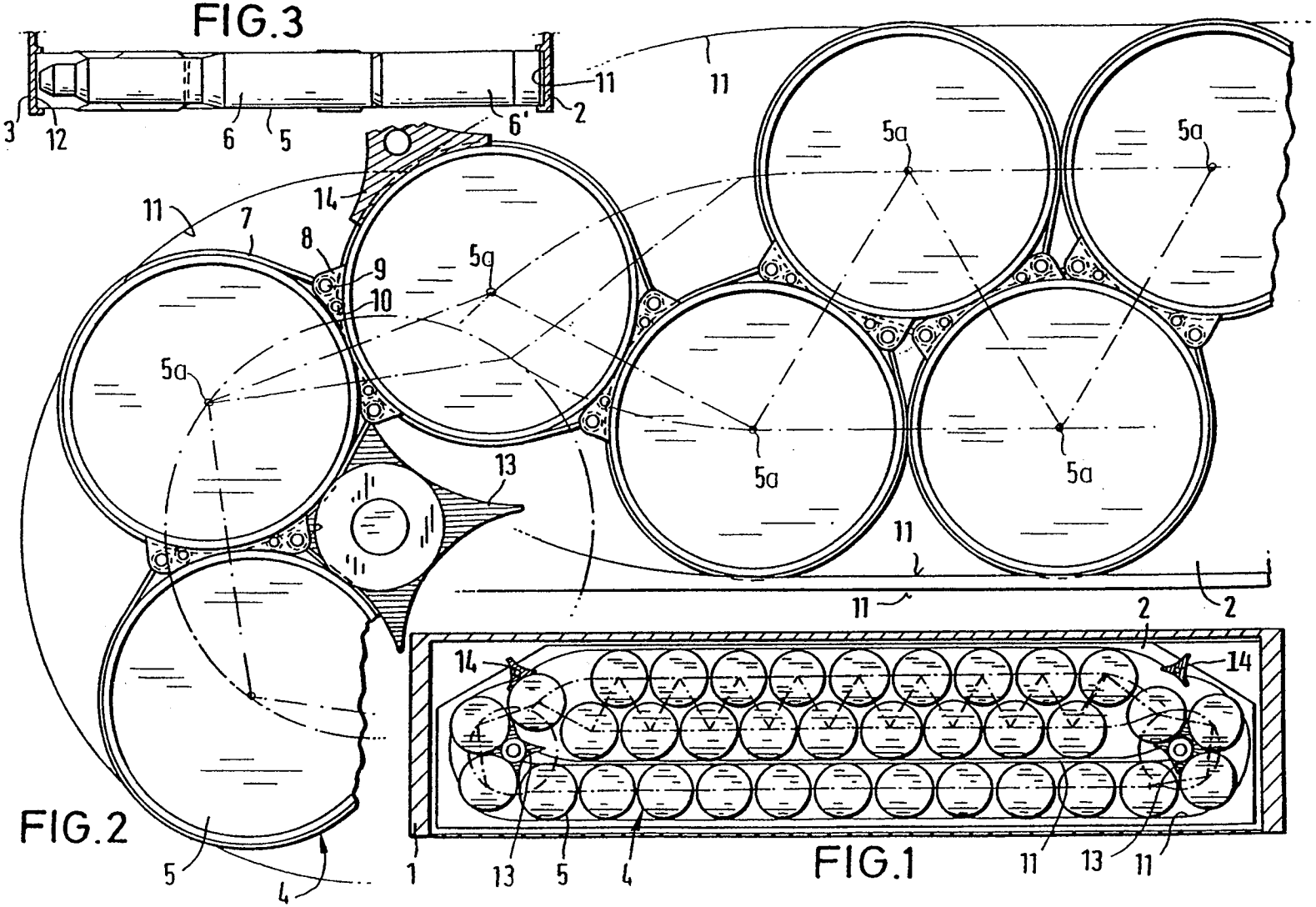
FIG. 1 is a schematic sectional view of a first embodiment of a circulating magazine according to the invention.
FIG. 2 is an enlarged sectional view of a portion of FIG. 1.
FIG. 3 is a schematic partial longitudinal sectional view through the lower layer of ammunition containers of FIG. 1 showing the guide grooves in the opposed front and rear housing walls.

The circulating magazine shown in FIGS. 1 to 3 comprises a housing 1 including a front wall 2 and a rear wall 3. Housing 1 accommodates a two-layer transporting belt 4 composed of ammunition containers 5 that are arranged parallel to one another and transversely to the front wall 2 and the rear wall 3. Ammunition containers 5 have a tubular configuration and each receives ammunition components 6 and 6', i.e. projectile 6 and propelling charge 6'.

In order to articulate adjacent ammunition container 5, each ammunition container 5 is provided with at least one tensioning band or strap whose ends are fastened to respective tabs 8 which are spaced from one another on the circumferential surface of the respective ammunition container 5. The tensioning of the bands 7 is adjustable by a respective eccentric member 9 mounted on each tab 8. Each tensioning band 7 of each ammunition container 5 encloses the outer surface (circumference) of an adjacent ammunition container 5 such that both containers are connected with one another by the tensioning bands 7 and are able to rotate relative to one another. Adjacent ammunition containers 5 therefore are in linear contact with one another at their respective peripheries, or preferably supported against one another by rollers 10 mounted in the respective tabs 8 so that such linear contact is just avoided i.e., the adjacent container is slightly spaced.

Guides or guideways 11 and 12 for substantially positively guiding the ammunition containers 5 are disposed respectively in the front wall 2 and in the rear wall 3. As can be seen in FIG. 3, the guides 11 and 12 are essentially grooves formed in or on the inner surface of the respective walls 2 and 3 and into which the respective front and rear ends of the ammunition containers 5 extend. In the region of the lower reach of the transporting belt 4 and in both its reversal regions (the regions wherein the belt reverses direction) these guides 11 and 12 have a width that corresponds to the diameter of the ammunition containers 5 to be guided. However, in the region of the upper layer of the belt 4, the diameter or width (height) of the guides becomes wider such that an approximately zigzag arrangement of ammunition containers 5 can be accommodated (the longitudinal axes 5*a* of ammunition containers 5 are arranged in a zigzag offset with respect to the transporting direction). In this manner, a quasi three-layer arrangement can be realized, with the total height occupied by ammunition containers 5 possibly and preferably being less than that of three layers of containers.

By way of two star-shaped, synchronized drive wheels 13 disposed in the spaced reversal regions of the transporting belt 4, the belt can be driven to rotate so that the upper layer of the transporting belt 4 is folded up practically until ammunition containers 5 contact one another and, in this state, pushes the block composed of accordion folded ammunition containers 5, while simultaneously this block of containers 5 is unfolded again in the opposite reversal region. If guides 11 and 12 are sufficiently free of play, movements of the transportation belt 4 to the right and left, i.e. in either direction, are possible without difficulty.

To compensate for possible inadequacies of guides 11 and 12 in the folding region, a supporting device, for example, star wheels 14, may be provided for the ammunition containers 5 in the intake region where the containers 5 enter into the broadened region of the guides 11 and 12. The respective devices 14 support and positively guide ammunition containers 5 moving upwardly through a respective reversal region, depending on the direction of rotation as can be seen in FIG. 1.

At a suitable location, preferably in the middle of the bottom layer or reach of belt 4, the front wall 2 and rear wall 3 may be provided with aligned holes (not shown), so that, for example, a rammer for a gun is able to push ammunition components 6 and 6' through ammunition container 5 into a gun. The ammunition components 6 and 6' may be introduced into the containers through other holes (not shown) in the rear wall 3.

Figure 4:
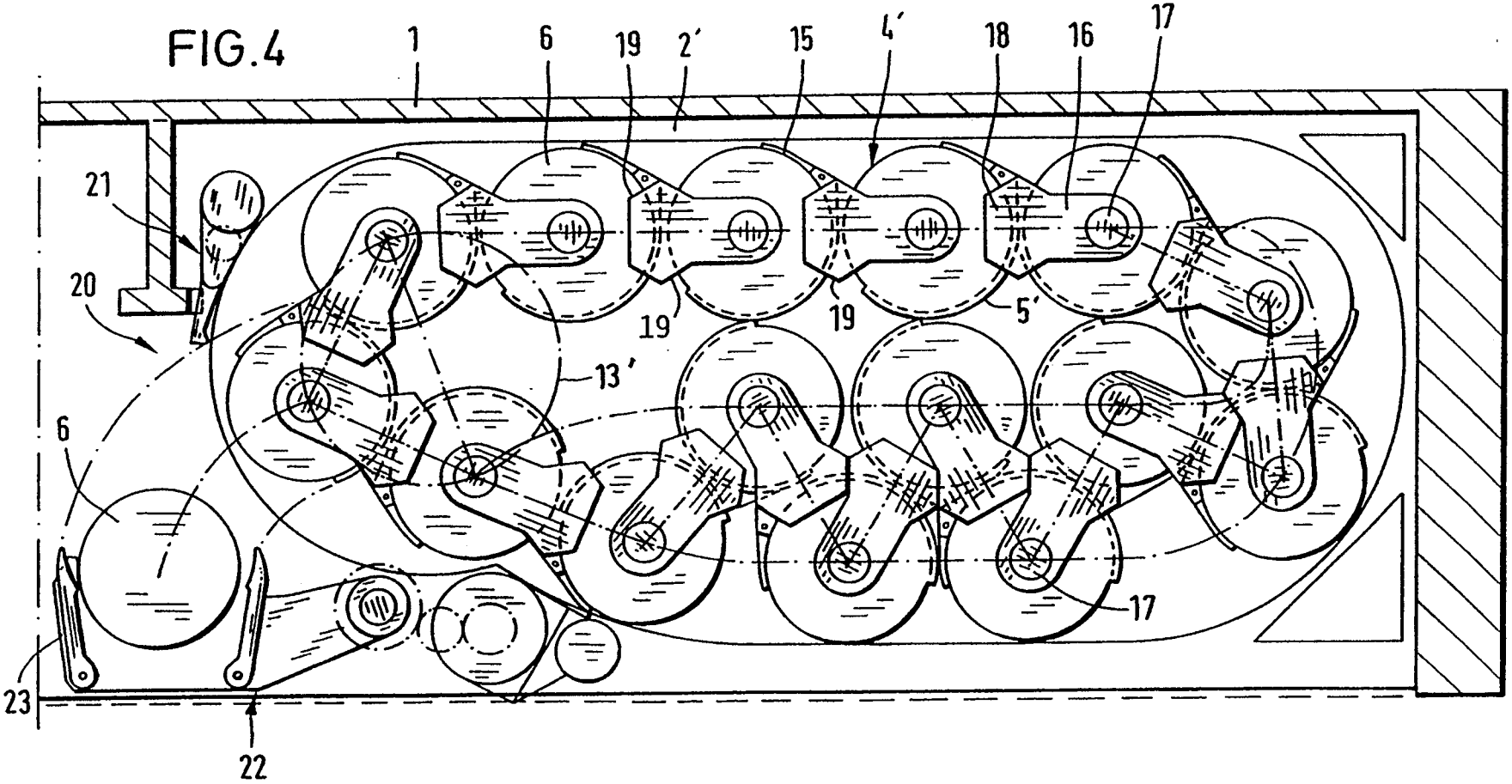
FIG. 4 is a schematic sectional view of a second embodiment of a circulating magazine according to the invention.

The circulating magazine shown in FIG. 4 is provided with tray-like ammunition containers 5' which accommodate ammunition components 6 and 6' which are held in the respective containers 5' by associated clamps 15 in a known manner. To form the transporting belt 4' according to this embodiment, each pair of adjacent ammunition containers 5' are connected with one another in a fixed spaced relationship by two connecting members 16 which each have one end fastened to the end surface of a respective ammunition container 5' and its other end articulated to the respective adjacent ammunition container 5' so as to pivot about its longitudinal axis. At the point of connection of each member 16 with the adjacent ammunition container 5' a respective roller 17, particularly a roller of the type provided with ball or needle bearings, is mounted so as to rotate about the longitudinal axis of the respective ammunition container 5'. These rollers 17 are guided by corresponding groove-shaped guides 11' and 12' in the front wall 2' and the rear wall 3'. In this embodiment a drive wheel 13' also engages the rollers 17 and takes over the internal guiding of groove-shaped guides 11 and 12 in the driving or reversal zone adjacent the wheel 13' region. In the region of the reversal zone for the transporting belt 4' disposed opposite the drive wheel 13', guides 11' and 12' branch out into two spaced strands that are re-united again shortly before reaching the region of drive wheel 13'.

The almost linear contact of the ammunition containers 5' in the folded, lower layer is inevitably effected by appropriately configuring the connecting members 16. In particular, each connecting member 16 is provided with a symmetrically broadened head 18 at its end which is fastened to the end surface of the associated ammunition container 5' in that a widened portion in the form of an equilateral triangle with equal sides or edges (19) and with base angles of 30° is disposed of both lateral sides of the member 16. The resulting sloped edge surfaces 19 of the head member 18 engage one another during the folding process and support one another as shown.

The use of smaller rollers 17 with corresponding bearings that run in groove-shaped guides 11' and 12', results in good guidance which makes additional supporting devices superfluous. Moreover, with a correspondingly smaller number of ammunition containers 5', a second drive wheel can be omitted as shown. This is appropriate if a lateral removal opening 20 is provided for two adjacent such circulating magazines through which, after release of the clamps 15 of a ammunition container 5' disposed in the removal position by means of a hooked release device 21, ammunition components 6 and 6' can be removed by a transfer device 22 and deposited from alternating sides on a loading tray 23. The supply of containers 5 to be moved is then smaller in each magazine and the possibilities for further selection are better.

Advisably, if transporting belt 4' has only one drive wheel 13', the guides 11' and 12' for ammunition containers 5' are foldingly effective in the push region of transporting belt 4' and unfoldingly effective in the pull region.

The invention now being fully described, it will be apparent to one of ordinary skill in the art that any changes and modifications can be made thereto without departing from the spirit or scope of the invention as set forth herein.

What is claimed is:

1. A circulating magazine comprising: a housing defined by housing walls including at least two oppositely disposed end walls; a plurality of parallely arranged ammunition containers for accommodating ammunition walls disposed in said housing and extending transverse to said two oppositely disposed end walls; means for articulatively connecting said containers together to form an endless transporting belt; drive means for rotating said endless transporting belt; and guide means, provided in said two oppositely disposed end walls of said housing, for guiding, and at least partially supporting, said ammunition containers such that said ammunition containers are disposed in two linearly extending layers, with said containers in one of said two layers being essentially folded and nested in a zigzag pattern.

2. A circulating magazine as defined in claim 1, wherein said guide means for said ammunition containers produces a folding effect of said containers to form said zigzag pattern in a first region wherein said transporting belt is being pushed by said drive means, and produces an unfolding effect in a second region wherein said transport belt is being pulled by said drive means.

3. A circulating magazine as defined in claim 1, wherein said connecting means contain rollers which are disposed between and support adjacent said ammunition containers against one another.

4. A circulating magazine as defined in claim 1, wherein said guide means comprises respective grooves formed in said two oppositely disposed end walls of said housing.

5. A circulating magazine as defined in claim 4, wherein said guide means further includes supporting means, disposed in an intake region for said folded layer of a respective said groove, for guiding respective said containers leaving a reversal region of said transporting belt.

6. A circulating magazine as defined in claim 5, wherein said supporting means comprises respective star wheels mounted on said two opposed end walls.

7. A circulating magazine as defined in claim 4, wherein said one of said two layers which is folded is an upper one of said two layers.

8. A circulating magazine as defined in claim 4, wherein said one of said two layers which is folded is a lower one of said two layers.

9. A circulating magazine as defined in claim 4, wherein said ammunition containers have a tubular configuration.

10. A circulating magazine as defined in claim 9, wherein each said groove includes a first portion having a width corresponding to the diameter of said containers, and a second portion having a width greater than said diameter, and wherein each end of each said container extends into an adjacent one of said grooves.

11. A circulating magazine as defined in claim 10, wherein said drive means comprises a pair of spaced synchronized star wheels disposed in respective reversal regions of said transporting belt.

12. A circulating magazine as defined in claim 9, wherein said means for connecting said containers with one another comprises respective elements fastened to each of said ammunition containers and each wrapped at least partially around an adjacent one of said ammunition container so as to permit rotation of adjacent said ammunition containers relative to one another.

13. A circulating magazine as defined in claim 12, wherein each of said elements is a respective tensioning belt.

14. A circulating magazine as defined in claim 4, wherein: said ammunition containers have a tray-like configuration; a respective roller is mounted at each end surface of each said ammunition container for rotation about a longitudinal axis of the respective said container; and said rollers are laterally held and supported by an associated one of said guide grooves.

15. A circulating magazine as defined in claim 14, wherein said means for connecting said ammunition containers comprises respective connecting members each having one end fastened to a respective said end surface of a respective said ammunition container and its opposite end articulated to a respective adjacent one of said ammunition containers so as to rotate about a longitudinal axis of said adjacent one of said ammunition containers.

16. A circulating magazine as defined in claim 14, wherein said one end of each said connecting member is provided with a symmetrically widened end portion having sloped edge surfaces of a configuration such that each of said edge surfaces can engage a respective edge surface of a respective one of said connecting members fastened to an adjacent one of said ammunition containers when the associated said ammunition containers are in a folded state.

* * * * *